US009732487B2

(12) United States Patent
Schattinger et al.

(10) Patent No.: US 9,732,487 B2
(45) Date of Patent: Aug. 15, 2017

(54) ARTIFICIAL TURF FIELD PAINT REMOVER AND EXTRACTION MACHINE

(71) Applicant: The Pioneer Manufacturing Company, Cleveland, OH (US)

(72) Inventors: J. Douglas Schattinger, Shaker Heights, OH (US); Brian Fenn, Macedonia, OH (US); Thomas A. Munich, Streetsboro, OH (US); Christopher S. Fiore, Avon Lake, OH (US); Joseph M. Orzechowski, Lakewood, OH (US)

(73) Assignee: The Pioneer Manufacturing Company, Cleveland, OH (US)

( * ) Notice: Subject to any disclaimer, the term of this patent is extended or adjusted under 35 U.S.C. 154(b) by 0 days.

(21) Appl. No.: 14/926,758

(22) Filed: Oct. 29, 2015

(65) Prior Publication Data

US 2016/0122957 A1 May 5, 2016

Related U.S. Application Data

(60) Provisional application No. 62/073,948, filed on Oct. 31, 2014.

(51) Int. Cl.
*E01H 1/08* (2006.01)

(52) U.S. Cl.
CPC ..... *E01H 1/0854* (2013.01)

(58) Field of Classification Search
CPC . E01H 11/0854; E01H 1/0845; E01H 1/0836; E01H 1/0827; A47L 11/4044; A47L 2201/00; A47L 5/00
See application file for complete search history.

(56) References Cited

U.S. PATENT DOCUMENTS 3,604,051 A * 9/1971 Wendel ..... E01H 1/0854 15/340.4
5,455,985 A * 10/1995 Hamline ..... A47L 11/4044 15/320

(Continued)

OTHER PUBLICATIONS

Three Photographs of Eco Mantis™ synthetic turf hydro extractor machine, manufactured/distributed by Eco Chemical, Seattle, WA.*

(Continued)

*Primary Examiner* — Dung Van Nguyen
(74) *Attorney, Agent, or Firm* — Tarolli, Sundheim, Covell & Tummino LLP

(57) ABSTRACT

A self-propelled field paint removal and extraction machine for removing paint from artificial turf athletic fields. The machine includes a self propelled, zero-turn rolling chassis including a frame defining a longitudinal axis of the machine; a brush assembly supported by the frame rearward of first and second front wheel caster assemblies and including a first outer brush rotating about a first brush axis of rotation and a second other brush rotating about a second brush axis, the brush assembly movable between a retracted position and a ground-contacting position; and a vacuum assembly supported by the frame rearward of the brush assembly and including a ground-contacting vacuum pad having a plurality of suction ports, the vacuum pad extending parallel to a lateral axis of the machine; and wherein the first and second brushes, in the retracted position of the brush assembly, are within a front footprint of the rolling chassis.

20 Claims, 16 Drawing Sheets

(56) References Cited

U.S. PATENT DOCUMENTS

| | | | | |
|---|---|---|---|---|
| 5,623,743 | A * | 4/1997 | Burgoon | A47L 11/30 15/320 |
| D637,625 | S | 5/2011 | Thunstrom et al. | |
| 8,584,294 | B2 * | 11/2013 | Loring | A47L 11/283 15/49.1 |
| 8,678,883 | B2 * | 3/2014 | Strickland | A47L 11/16 15/340.4 |
| 2007/0174980 | A1 * | 8/2007 | Prevost | E01H 1/101 15/50.1 |
| 2009/0023369 | A1 * | 1/2009 | Thysell | B24B 41/047 451/350 |
| 2010/0197210 | A1 * | 8/2010 | Goldberg | B24B 7/186 451/353 |
| 2014/0096984 | A1 | 4/2014 | Thunstrom et al. | |

OTHER PUBLICATIONS

Specification Sheet for Eco Mantis™ synthetic turf hydro extractor machine, manufactured/distributed by Eco Chemical, Seattle, WA, revision/publication date Oct. 18, 2009. (1 page) (Exhibit A).

Specification Sheets for Kromer Field Commander™ machine, manufactured/distributed by Kromer Co. LLC, Plymouth, MN, publication date Dec. 16, 2010. (2 pages) (Exhibit C).

* cited by examiner

ARTIFICIAL TURF FIELD PAINT REMOVER AND EXTRACTION MACHINE

CROSS REFERENCE TO RELATED APPLICATION

The following application claims priority under 35 U.S.C. §119(e) to U.S. Provisional Patent Application Ser. No. 62/073,948, filed Oct. 31, 2014 entitled ARTIFICIAL TURF PAINT REMOVER AND EXTRACTION MACHINE. The above-identified provisional patent application is incorporated herein by reference in its entirety for all purposes.

TECHNICAL FIELD

This disclosure relates to a self-propelled machine for removing and extracting field paint from artificial or synthetic turf.

BACKGROUND

Artificial or synthetic turf systems are widely used as playing surfaces in indoor and outdoor athletic fields, stadiums, and the like as a replacement for natural grass. Typically, a synthetic turf system includes an artificial turf comprising a texture or array of synthetic fibers are disposed in an upright position extending from an underlying polypropylene mat or base. Curly synthetic fibers may be interspersed between the upright fibers to maintain the upright fibers in an upright position, having the appearance and resiliency of blades of grass. Infill material is added between the synthetic fibers to provide for additional cushioning effect and to protect the attachment of synthetic fibers to the underlying mat or base. Early did not utilize any infill material, while more modern artificial turf utilize a mixture of sand and recycled rubber granules as the infill materials.

Often different sports games and events are held on the same artificial turf playing surface, e.g., the same artificial turf playing surface may be used as a football field for a college football game on Saturday, a soccer field for a college or professional soccer game on Sunday, and a football field for a professional football game the next week. Each game or event may require different field markings, different team names, logos, and athletic conference or professional league symbols or emblems, and the like, to be painted on the artificial turf. Typically, specialty paint used for such artificial field markings is referred to as artificial turf field marking paint.

Between games or events, it may be necessary to remove some or all of the field marking paint from areas of the artificial turf prior to application of new field marking paint for an upcoming game or event. Removal of the field marking paint requires both: a) removal or dislodging the existing field marking paint from the individual synthetic fibers; and 2) extraction of the dislodged field marking paint from the artificial turf.

The time between games or events may be limited and the area of paint marking over the playing surface that must be removed and extracted may be considerable (e.g., field paint may be applied to the entirety of both end zones in a football game). Further, areas of the playing surface where paint needs to be removed and extracted may be short and discontinuous over a large extent of the playing surface, e.g., removal of yard line and hash line markings from a football field. All of the foregoing complicates the field paint removal and extraction process.

SUMMARY

In one aspect, the present disclosure concerns a paint removal and extraction machine, the machine including: a self propelled rolling chassis including a frame having a front end and a back end and pair of spaced apart longitudinally extending rails defining a longitudinal axis of the machine centered between and parallel to the pair of rails and a lateral axis orthogonal to the longitudinal axis and extending through the longitudinally extending rails, first and second front turning wheels coupled to the front end of the frame by respective first and second caster assemblies, the first and second front turning wheels defining first and second turning wheel axes of rotation, respectively, and the first and second caster assemblies defining first and second caster axes of rotation, respectively, the first and second caster axes of rotation being orthogonal to the first and second turning wheel axes of rotation, first and second drive wheels coupled to the frame, rotation of at least one of the first and second drive wheels propelling the rolling chassis; a brush assembly supported by the frame rearward of the first and second caster assemblies and including a first outer brush rotating about a first brush axis of rotation and a second other brush rotating about a second brush axis, the brush assembly movable between a first, retracted position and a second, ground contacting position; and a vacuum assembly supported by the frame rearward of the brush assembly and including a ground-contacting vacuum pad having a plurality of suction ports, the vacuum pad extending parallel to the lateral axis of the machine; and wherein the first outer brush and the second outer brush, in the retracted position of the brush assembly, are within a front footprint of the rolling chassis, that is, a region of the rolling chassis extending rearwardly parallel to the longitudinal axis between the outermost edges of the first and second front turning wheels when the first and second turning wheels are in a splayed position such that the axes of rotation of the first and second turning wheels are maximally spaced apart and parallel to the longitudinal axis.

In another aspect, the present disclosure concerns a paint removal and extraction machine, the machine including: a self propelled rolling chassis including a frame having a front end and a back end and pair of spaced apart longitudinally extending rails defining a longitudinal axis of the machine centered between and parallel to the pair of rails and a lateral axis orthogonal to the longitudinal axis and extending through the longitudinally extending rails, first and second front turning wheels coupled to the front end of the frame by respective first and second caster assemblies, the first and second front turning wheels defining first and second turning wheel axes of rotation, respectively, and the first and second caster assemblies defining first and second caster axes of rotation, respectively, the first and second caster axes of rotation being orthogonal to the first and second turning wheel axes of rotation, first and second drive wheels coupled to the frame, rotation of at least one of the first and second drive wheels propelling the rolling chassis; a brush assembly supported by the frame rearward of the first and second caster assemblies and including a first outer brush rotating about a first brush axis of rotation and a second other brush rotating about a second brush axis, the brush assembly movable between a first, retracted position and a second, ground-contacting position; and a vacuum assembly supported by the frame rearward of the brush assembly and including a ground-contacting vacuum pad having a plurality of suction ports, the vacuum pad extending parallel to the lateral axis of the machine; and wherein the plurality of vacuum ports of the vacuum pad are within the front footprint of the rolling chassis.

BRIEF DESCRIPTION OF THE DRAWINGS

The foregoing and other features and advantages of the present disclosure will become apparent to one skilled in the art to which the present invention relates upon consideration of the following description of the invention with reference to the accompanying drawings, wherein like reference numerals refer to like puts unless described otherwise throughout the drawings and in which.

DETAILED DESCRIPTION

Figure 1:
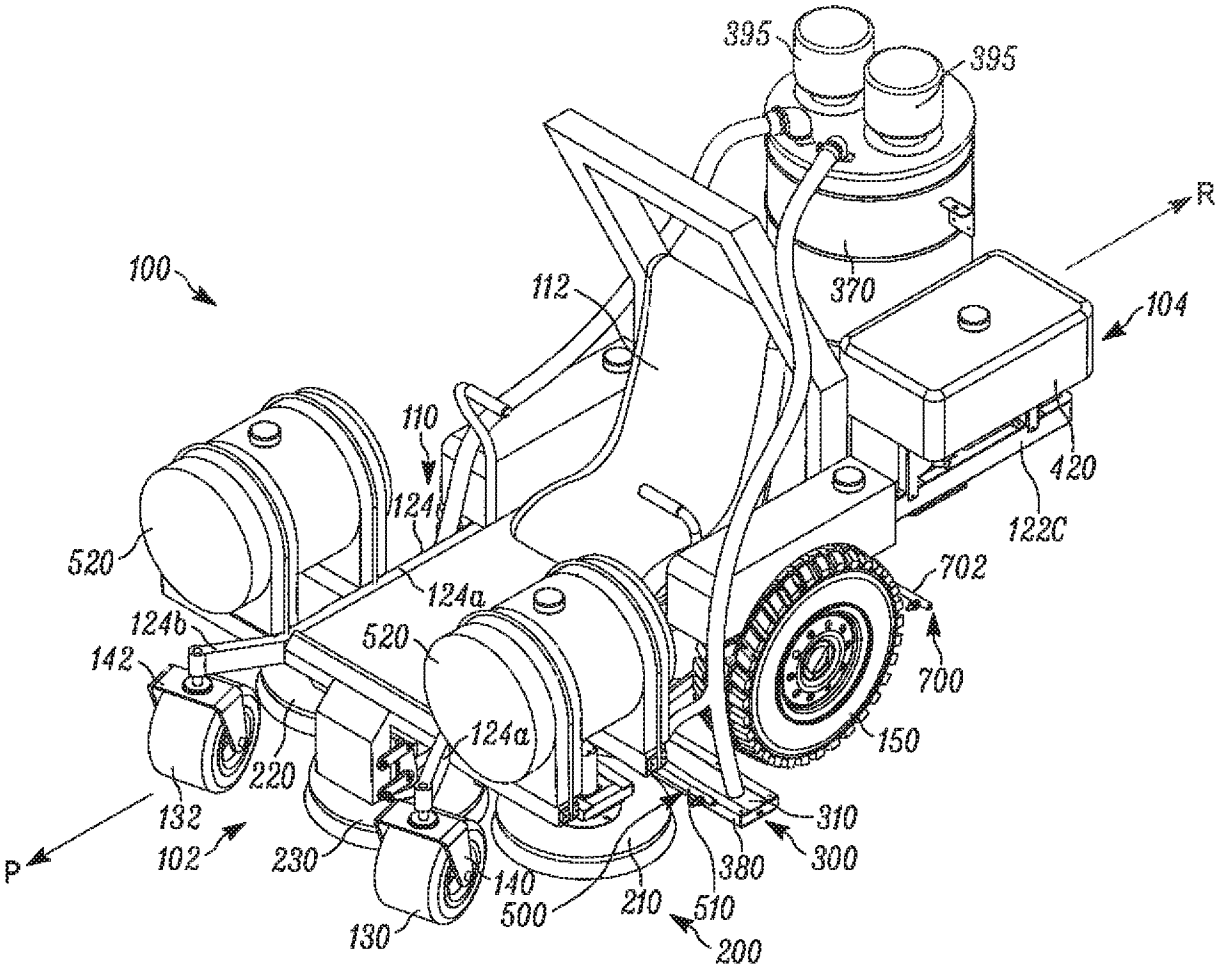
FIG. 1 is a schematic left side, front perspective view of a exemplary embodiment of an artificial turn field paint remover and extraction machine of the present disclosure.

Referring now to the Figures generally wherein like numbered features shown therein refer to like elements throughout unless otherwise noted. The present disclosure relates to a paint remover and extraction machine and, more specifically, to a self-propelled paint remover and extraction machine 100 suitable for removing and extracting field paint from a section of artificial or synthetic turf to be cleaned. The field paint applied to an artificial turf playing surface adheres to the resilient, synthetic artificial turf fibers. The field paint is removed by agitation, contact, deflection and brushing of the painted synthetic turf fibers by a plurality of rotating brushes of a brush assembly 200 of the machine 100. The rotating brushes of the brush assembly 200 contact, deflect and brush against the turf fibers. In one exemplary embodiment a triad of brushes is utilized including first and second outer brushes 210, 220 that flank and are displaced to the rear of an inner or central lead brush 230, The brushes 210, 220, 230 are located near a front end of the machine 100 and the brush assembly is affixed to a frame 120. The frame 120 is part of a self-propelled rolling chassis 110 of the machine 100.

The dislodged field paint is then extracted from the turf by a vacuum suction provided by a vacuum assembly 300 of the machine 100. The vacuum assembly 300 includes a vacuum bar 310 supported by frame 120 and disposed just rearward of the brushes 210, 220, 230 of the brush assembly 200. The vacuum bar 310 is a three part sandwiched configuration including a ground contacting vacuum pad or suction plate 320, an intermediate plenum 340, and a top plate. The vacuum pad 370 includes a plurality of ports 312 that terminate in respective slotted openings 314 at a ground contacting or bottom surface 330 of the vacuum pad 320. Additionally, depending on the characteristics of the field paint, a field paint dissolving solution may be applied by a spray boom assembly 400 of the machine 100 to the field paint in a first run or pass of the machine 100 in order to facilitate paint removal by loosening and/or partially dissolving the field paint.

Figure 17:
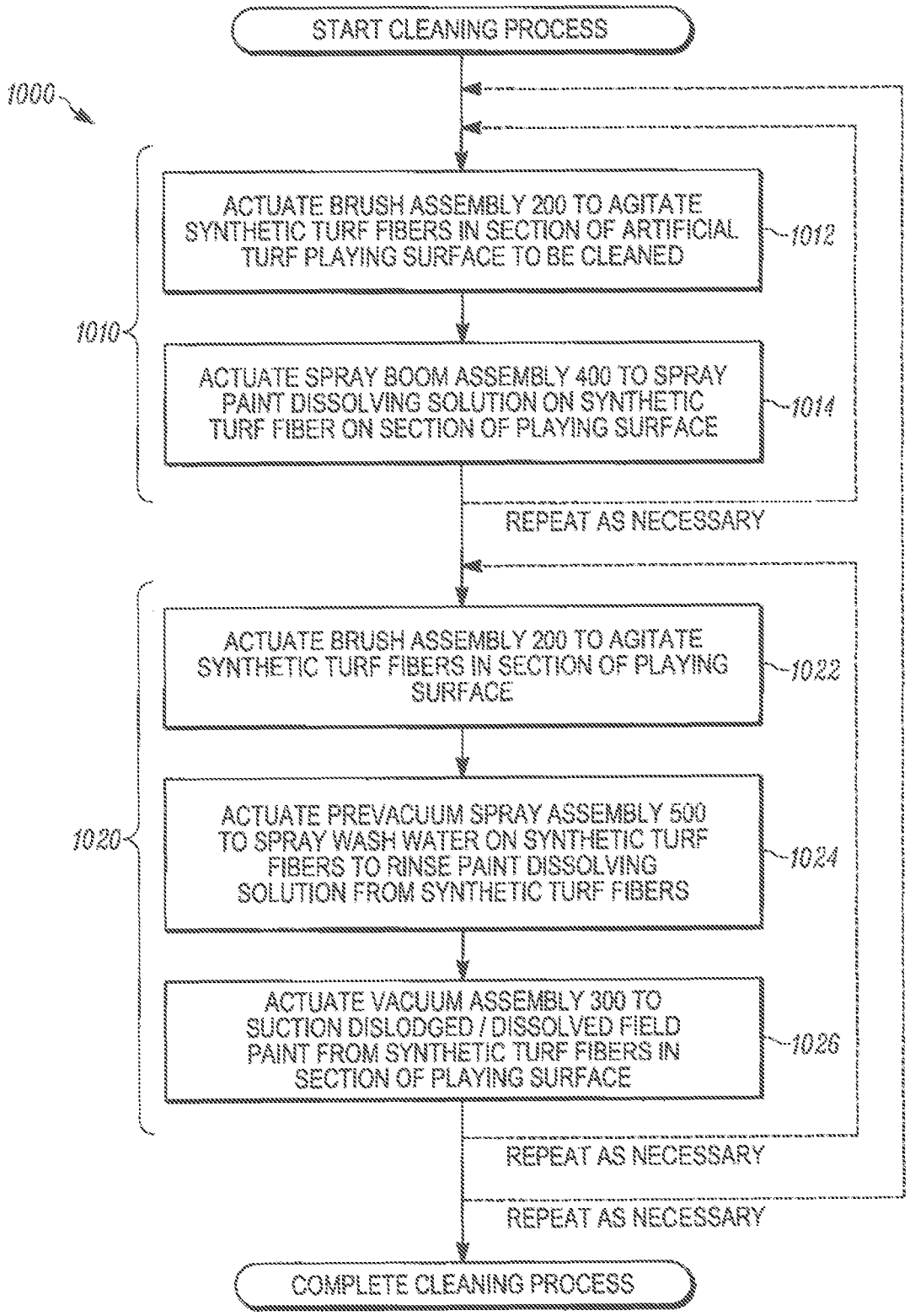
FIG. 17 is a schematic flow diagram of a field paint removal and extraction process, utilizing the field paint remover and extraction machine of FIG. 1.

As schematically shown in the flow diagram of FIG. 17, in one exemplary embodiment, the field paint removal and extraction process 1000 involves two steps 1010, 1020 corresponding to two runs or passes of the machine 100 over a section of the playing field to be treated or cleaned (i.e., cleaned by having the field paint removed and extracted from the synthetic turf fibers). In an optional first or conditioning run 1010, the brush assembly 200, which is mounted near a front end **120*a* of a frame 120 of the machine 100, at step 1012, is actuated or operated to contact and agitate the synthetic turf fibers to loosen the paint adhering to the fibers. The brush assembly 200 is in its downward or ground-contacting position, as opposed to a retracted or non ground-contacting position. Further, the spray boom assembly 400 mounted near a rear end 120*b* of the frame 120 is actuated to spray a paint dissolving solution on the recently agitated turf fibers to wet the fibers with the dissolving solution to further loosen and partially dissolve the paint on the fibers. The vacuum assembly 300 of the machine 100 is not operated in the first conditioning run 1010**.

Referring again to FIG. 17, in the second run, shown at step 1020, referred to as the field paint remover and extraction run, the machine 100 is passed over the same section of the artificial turf for additional treatment. The brush and vacuum assemblies 200, 300 are both actuated or operated in the remover and extraction run, while the spray boom assembly 400 is not operated. The brush assembly 200 is in its downward or ground-contacting position. Similarly, the vacuum assembly 300 is in its downward or ground-contacting position, as opposed to a retracted or non ground-contacting position.

At step 1022, the brush assembly 200 is actuated such that the plurality of brushes 210, 220, 230 rotate contact and agitate the synthetic fibers thereby further loosening and dislodging the paint (which may be partially dissolved from the first run 1010) from the fibers and thereby effectively removing the field paint from the synthetic turf fibers. At step 1026, the vacuum assembly 300 is actuated and a vacuum bar 310 of the vacuum assembly 300 passes over the agitated fibers and, via vacuum suction, the vacuum bar draws the dislodged and/or dissolved paint through a vacuum pad 320 into the vacuum bar 310. Under vacuum pressure, the dislodged and/or dissolved paint is then routed from the vacuum pad 320 through a plenum 340 and a top plate 360 of the vacuum bar 310, though a manifold 372, a pair of vacuum hoses 375 and deposited into a vacuum extraction holding tank 370 mounted on the frame 120 of the machine 100. Accordingly, in the removal and extraction run 1020, the field paint is removed and extracted from the synthetic turf fibers.

If the optional first run 1010 is used and paint remover solution is sprayed on the artificial turf by the spray boom assembly 400, a pre-vacuum water spray assembly 500 is actuated in the second run 1020 to spray wash water on the fibers prior to extraction of the field paint by the vacuum assembly. This is show as step 1024 of the cleaning process 1000 in FIG. 17. The purpose of the water spray assembly 500 is to wet the synthetic fibers such that the dislodged paint and any remaining paint dissolving solution are efficiently vacuumed up by the vacuum assembly 300 and the solution does not remain on the synthetic fibers. It is not desirable to leave paint, dissolving solution on the synthetic turf fibers because the dissolved paint will tend to run down to the bottom of the turf fibers and will subsequently harden as the dissolving solution dries thereby creating a hardened or solidified layer of field paint at the base of the turf fibers. Over repeated paint removal and paint application processes this will, in certain situations where the playing surface or artificial turf field has inadequate drainage, result in less cushioning effect by the turf fibers and produce an undesirable harder playing surface.

The use of a first preliminary conditioning run 1010 and a second removal and extraction run 1020 by the machine 100 is suitable in situations where the field paint to be used has a water-based latex paint composition that is amenable to being at least partially thinned or dissolved by field paint dissolving solution utilizing a high pH composition. Such a water-based latex athletic field marking paint is sold under the trademark GAMELINE® field paint by The Pioneer Athletic Company, Cleveland, Oh. 44135, the assignee of the present application. A suitable field paint dissolving solution is sold under the trademark BLITZ™ by The Pioneer Athletic Company, Cleveland, Oh. 44135, the assignee of the present application. For other applications where the field paint is not amenable to thinning or dissolving by a paint dissolving solution, a single run, namely, the second removal and extraction run 1020, as described above is used. As would he understood by one of ordinary skill in the art, if necessary for complete paint removal, the steps of the process 1000 including the first step or run 1010 and/or the second step or run 1020 may be repeated over a section of artificial turf, as necessary, until a satisfactory field paint removal and extraction result is achieved.

Figure 2:
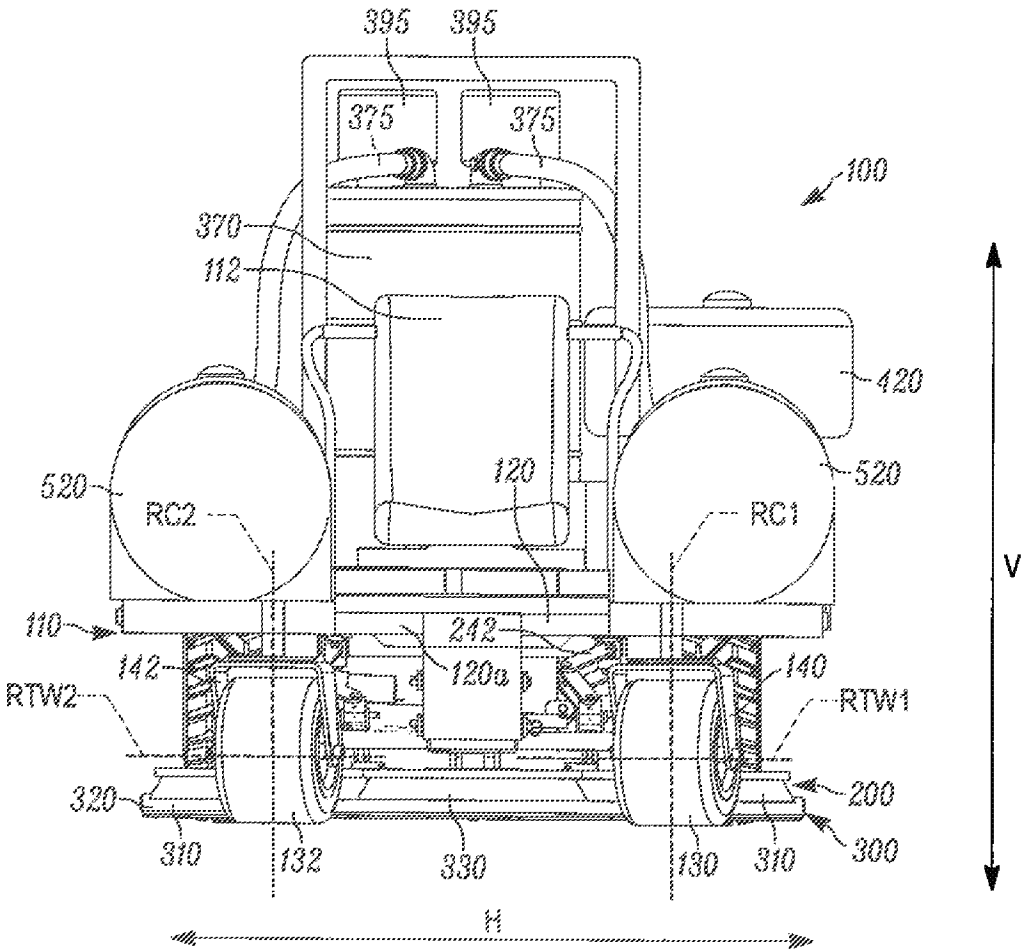
FIG. 2 is a schematic front elevation view of the of the field paint remover and extraction machine of FIG. 1.
Figure 3:
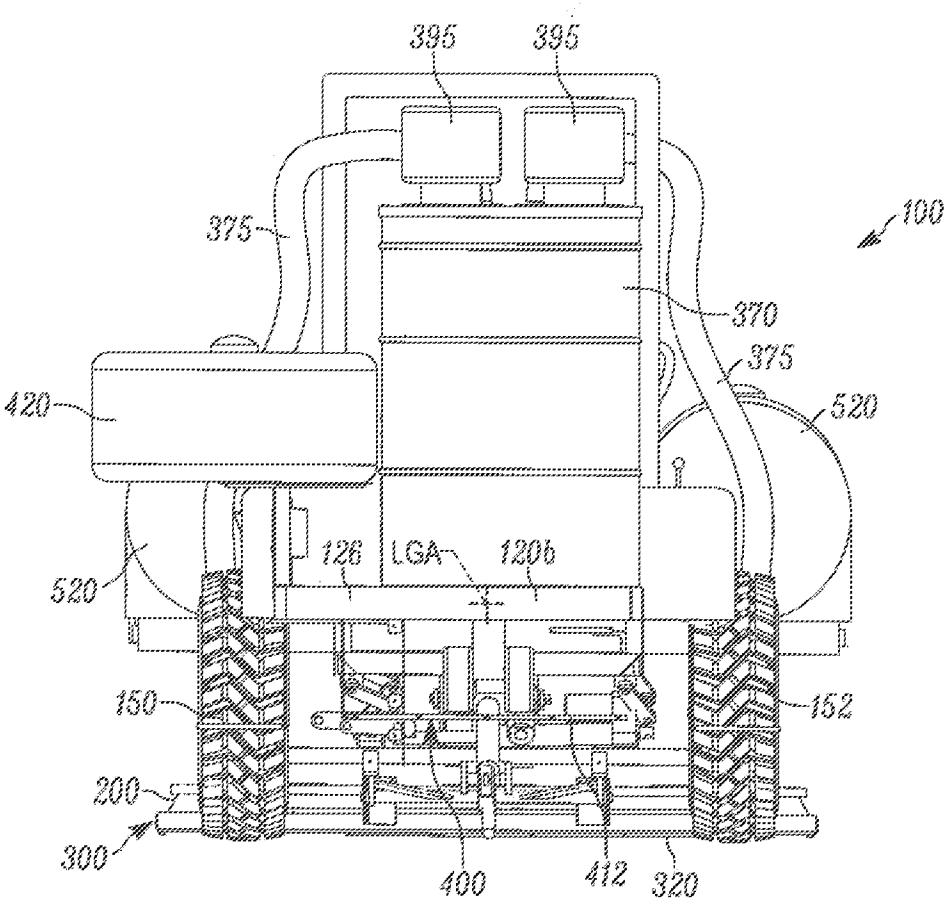
FIG. 3 is a schematic rear elevation view of the field paint remover and extraction machine of FIG. 1.

Turning to the drawings, an exemplary embodiment of the self-propelled, field paint remover and extraction machine of the present disclosure is shown generally at 100 in FIGS. 1-6. For purposes of convenience, the forward direction F is the direction that an operator would be looking when seated in an operator's seat 112 and that the machine 100 generally moves when operated to remove and extract field paint in either a first or a second run 1010, 1020. A rearward direction R is a reverse of the forward direction F and would be the direction that the machine 100 is moved when backing the machine 100 away from an obstacle or to reposition the machine on the playing surface to clean another section of artificial turf. A vertical direction V and a horizontal direction H (which is parallel to the ground (artificial turf) are also shown in FIG. 2 for orientation purposes.

Figure 4:
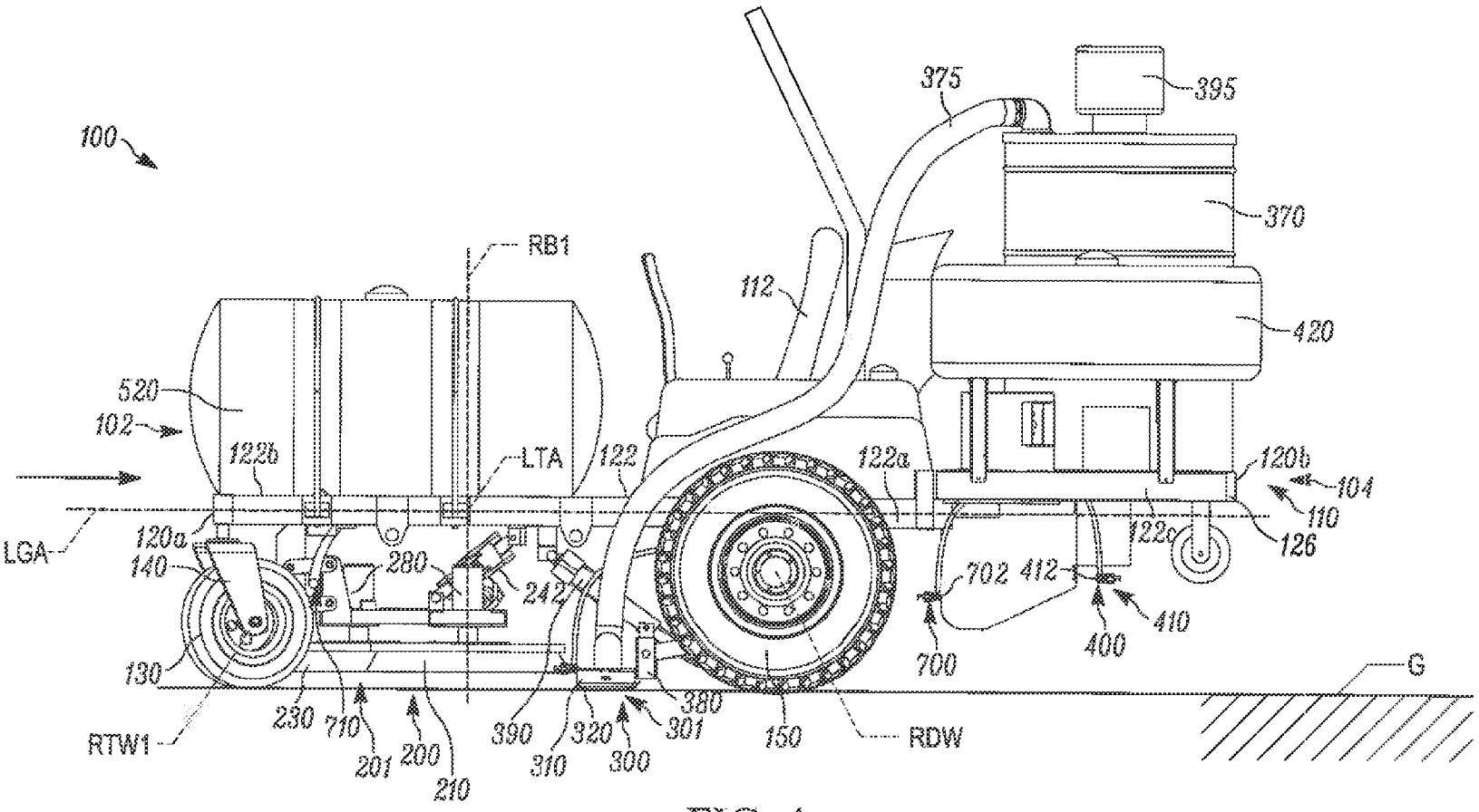
FIG. 4 is a schematic left side elevation view of the field paint remover and extraction machine of FIG. 1.
Figure 5:
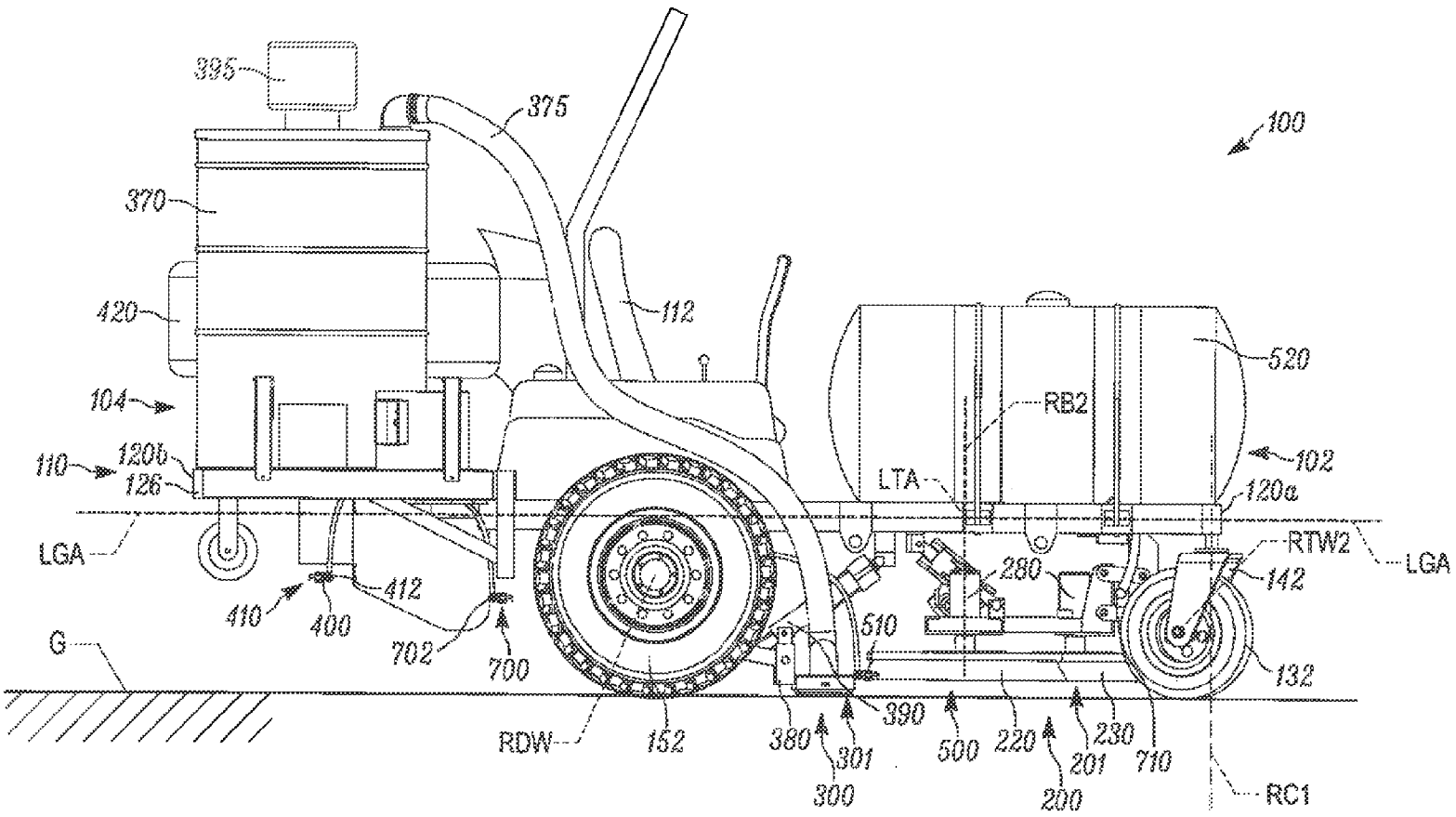
FIG. 5 is a schematic right side elevation view of the field paint remover and extraction machine of FIG. 1.

As can hest be seen in FIGS. 4 and 5, a forward end of the machine 100 is shown generally at 102, while a rearward or rear end of the machine 100 is shown generally at 104. The machine 100 includes the rolling chassis 110 which is both zero-turn (as in a mower with a zero-turn steering mechanism) and self-propelled. The brush assembly 200 mounted to the frame 120 of the rolling chassis 110 near the front end 102 of the machine 100 for loosening and dislodging paint from the synthetic turf fibers. The vacuum assembly 300 is mounted rearward of the brush assembly 200 for suctioning the dislodged and/or dissolved paint from the fibers. The spray boom assembly 400 is mounted near the rear end 104 of the machine 100 for wetting or spraying the turf fibers with paint dissolving solution if the field paint to be removed is of a type that is conducive to being dissolved or thinned by a paint dissolving solution and a first run is utilized in the removal and extraction process 1000. The machine 100 further includes the pre-vacuum spray assembly 500 which is mounted forward of the vacuum assembly 300 to apply wash water to the turf fibers if a paint dissolving solution is utilized in the first conditioning urn 1010. The machine 100 further includes auxiliary wheel spray assemblies 700, 710 for spraying wash water on the front turning wheels 130, 132 and the rear drive wheels 150, 152 of the roiling chassis 110.

In one exemplary embodiment, the roiling chassis 110 of the machine 100 is a modification of a rolling chassis of a zero-turn, self-propelled lawn mower such as the model 932145 Super Z Hyper Drive industrial mower sold by Hustler Turf Equipment, Hesston, Kans. 67062. The rolling chassis 110 includes the frame 120, the pair of front turning wheels 130, 132 mounted on respective rotating caster assemblies 140, 142 to provide for zero-turn steering of the machine 100. The roiling chassis 110 further includes a powertrain, including an engine and an engine drivetrain, to provide motive power to at least one or both of the pair of rear drive wheels 150, 152. On one exemplary embodiment, the engine is a 27 horsepower engine.

Figure 6:
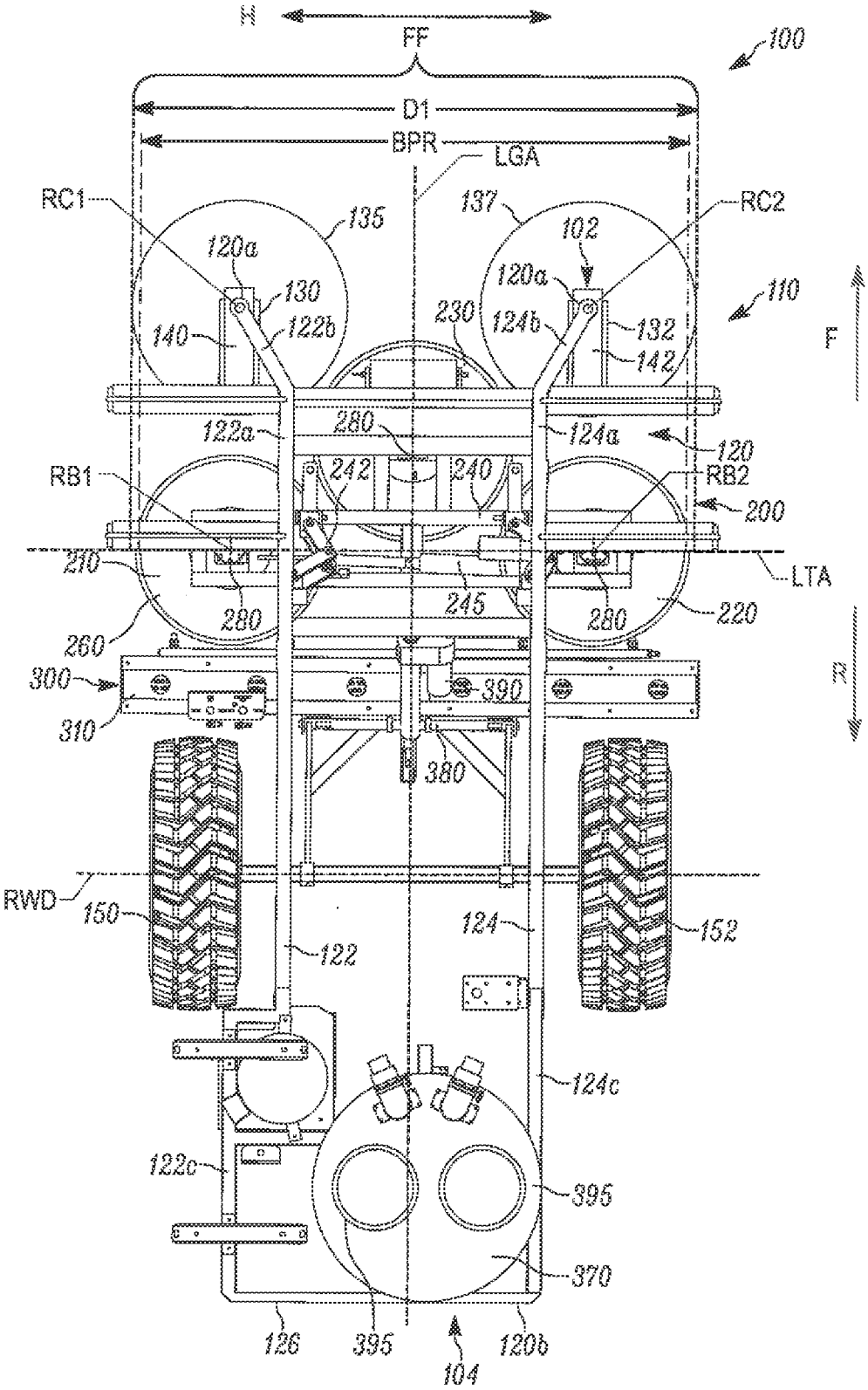
FIG. 6 is a schematic top plan view of the field paint remover and extraction machine of FIG. 1, with selected components removed to better show a rolling chassis, a brush assembly and a vacuum assembly of the machine.
Figure 7:
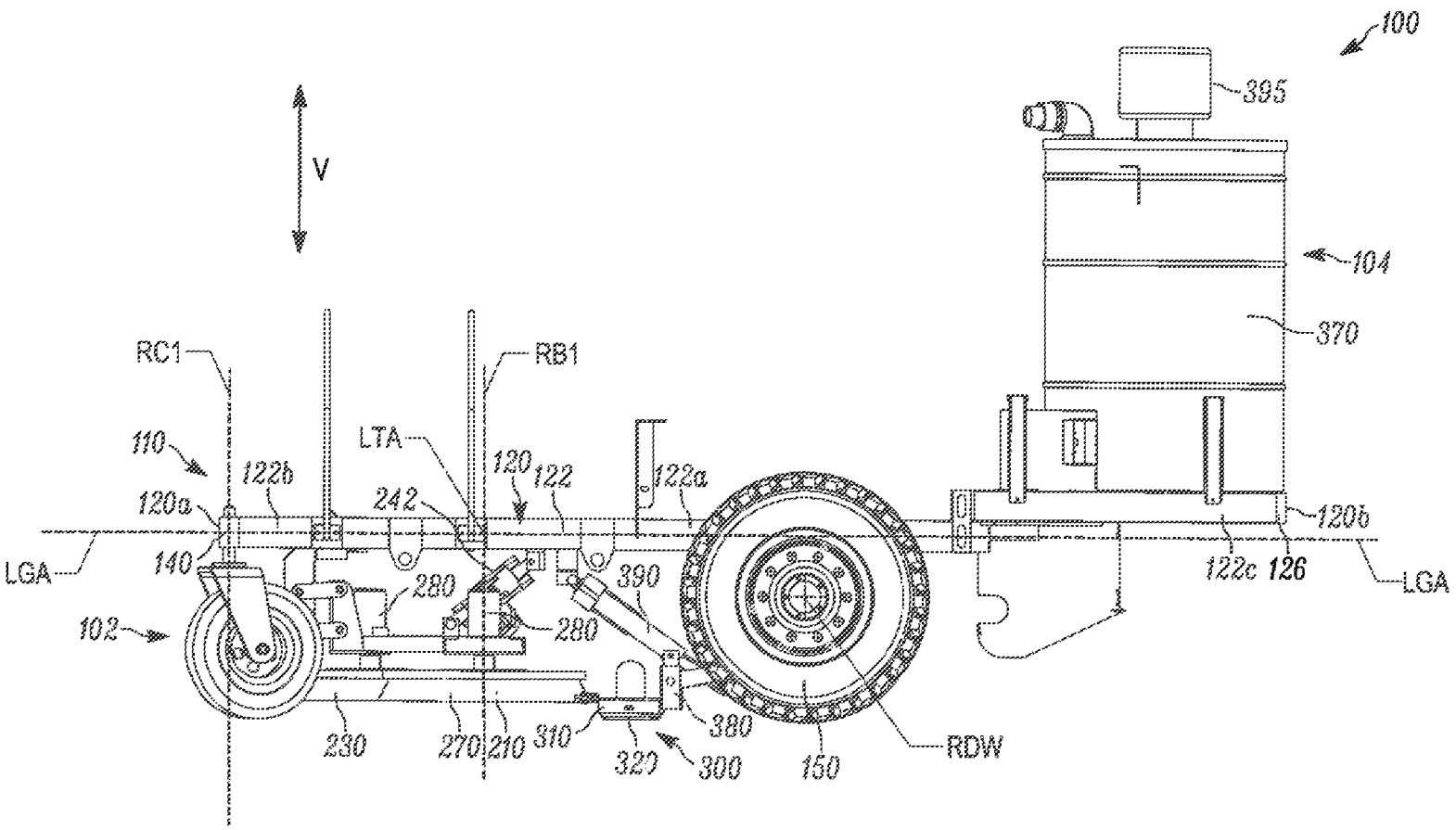
FIG. 7 is a schematic left side elevation view of the field paint remover and extraction machine of FIG. 1, with selected components removed to better show the brush assembly and the vacuum assembly of the machine.

As can hest be seen in FIGS. 6 and 7, the frame 120 supports the front turning wheels 130, 132, the rotating caster assemblies 140, 142, the engine powertrain, the rear drive wheels 150, 152, as well as the brush, vacuum, spray boom assembly, pre-vacuum water spray assemblies, and auxiliary wheel spray assemblies 200, 300, 400, 500, 700, 710. The frame 120 includes a pair of substantially parallel, longitudinally extending frame members 122, 124. Parallel central portions 122*a*, 124*a* of the frame members 122, 124 define a centerline or longitudinal axis LGA of the machine 100 that is substantially centered between and extending along central portions 122*a*, 124*a* of the longitudinal frame members 122, 124. The parallel central portions 122*a*, 124*a* of the frame members 122, 124 also define a lateral axis LTA of the machine 100 that intersects and is orthogonal to the longitudinal axis LGA. The lateral axis LTA passes orthogonally though the frame members 120, 122 at positions that intersect an axis of rotation RB1 of the first outer brush 210 and an axis of rotation RB2 of the second outer brush 220 of the brush assembly 200. When the machine 100 is used on a level section of artificial turf playing surface, both the longitudinal and lateral axes LGA, LTA are substantially parallel to the ground (artificial turf) G.

Respective forward portions 122*b*, 124*b* of the frame members 122, 124 flare outwardly adjacent a front end 120*a* of the frame 120 and define mounting regions for respective front wheel casters 140, 142. The front end 120*a* of the frame 120 generally corresponds to the forward end 102 of the machine 100. Respective rear portions 122*c*, 124*c* of the frame members 122, 124 and a rear cross bar 126 are added to the existing Hustler mower frame to provide a support surfaces for the spray boom assembly 400, the bolding tank 370 and a holding tank 420, which stores the field paint dissolving solution.

The front wheel casters 140 are coupled to the forward portions 122*b*, 124*b* of the frame members 122, 124 and rotate about respective caster axis of rotation RC1, RC2, which are substantially vertical in orientation and orthogonal to the longitudinal and lateral axes LGA, LTA of the machine 100. The front turning wheels 130, 132 rotate about respective independent front turning wheel axes of rotation, RTW1, RTW2 that are substantially parallel to the machine longitudinal and lateral axes LGA, LTA. The rear drive wheels 150, 152 rotate about a drive wheel axis of rotation RWD that is parallel to the lateral axis LTA.

Brush Assembly 200

As noted previously, the brush assembly 200 includes triangle of three rotating brushes, two outer brushes 210, 220 and the central brush 230. The axes of rotation RB1, RB2, RB3 of the three brushes 210, 220, 230 are parallel. The brushes 210, 220, 230 are mounted to a T-shaped brush frame 240. Links 242 (best seen in FIG. 7) are disposed between the brush frame 240 and parallel central portions 122*a*, 122*b* of the frame rails 122, 124. The brush assembly 200 includes a linear actuator 245 (FIG. 6) which moves the brush frame 240 and thereby the brushes 210, 220, 230 between the upward or retracted position wherein the brushes do not contact the ground G (the artificial turf—shown schematically in FIGS. 4 and 5) and the downward or ground-contacting position wherein the brushes contact the artificial turf synthetic fibers and agitate the fibers when the brush assembly 200 is actuated to remove the field paint from the fibers. The retracted position of the brush assembly 200 is shown at 201, for example, in FIGS. 4 and 5 wherein the brushes 210, 220, 230 are spaced vertically upward above the ground G. In one exemplary embodiment, the linear actuator 245 is an 8 inch stroke Acme drive.

Each of the three brushes 210, 330, 330 is nominally 20 inches in diameter and includes a disk-shaped base 260 and a central or mounting portion 262 of the base. The central or mounting portion 262 of each of the brushes 210, 220, 230 provides for: a) mounting the brushes 210, 220, 230; and b) receiving a drive coupling of a hydraulic motor 280. The three hydraulic motors 280, one for each of the brushes 210, 220, 230, are powered by a hydraulic pump, which is coupled via a PTO belt to the engine power take off. The engine power take off includes an electric clutch and drives the PTO belt which, in turn, powers the hydraulic pump. The three hydraulic motors 280 are coupled in series to provide rotation of the brushes 210, 220, 230 when the brush assembly 200 is actuated. Another belt, a main belt, runs of the engine and powers a generator. The generator produces electricity need for valves, water pump, vacuum heads and a GFCI outlet. When the engine is idling, the generator is not producing power. The generator requires 11 HP and about 3,200 RPM to start working.

Figure 14:
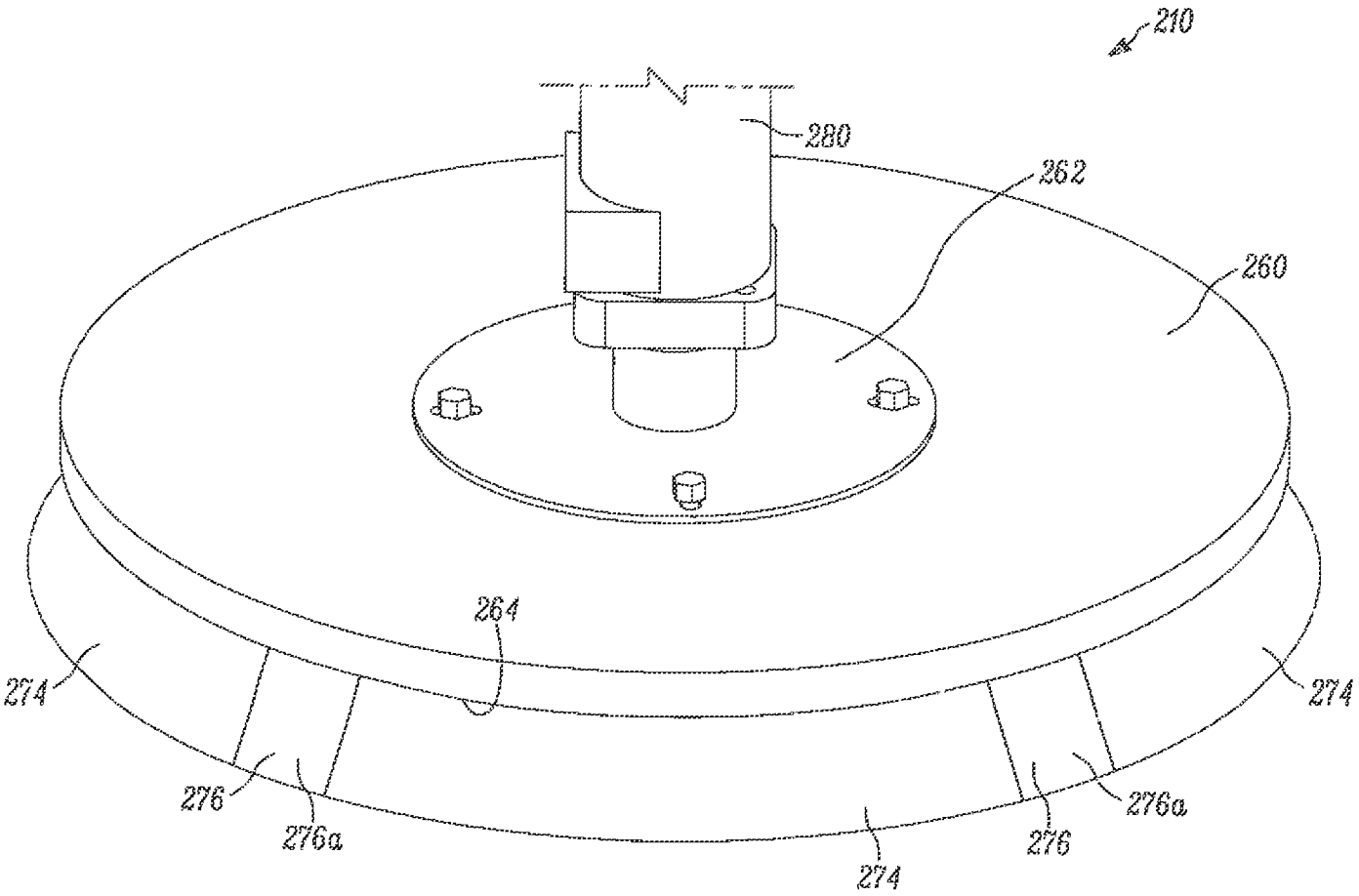
FIG. 14 is a schematic top perspective view of a brush of the brush assembly of the field paint remover and extraction machine of FIG. 1.
Figure 15:
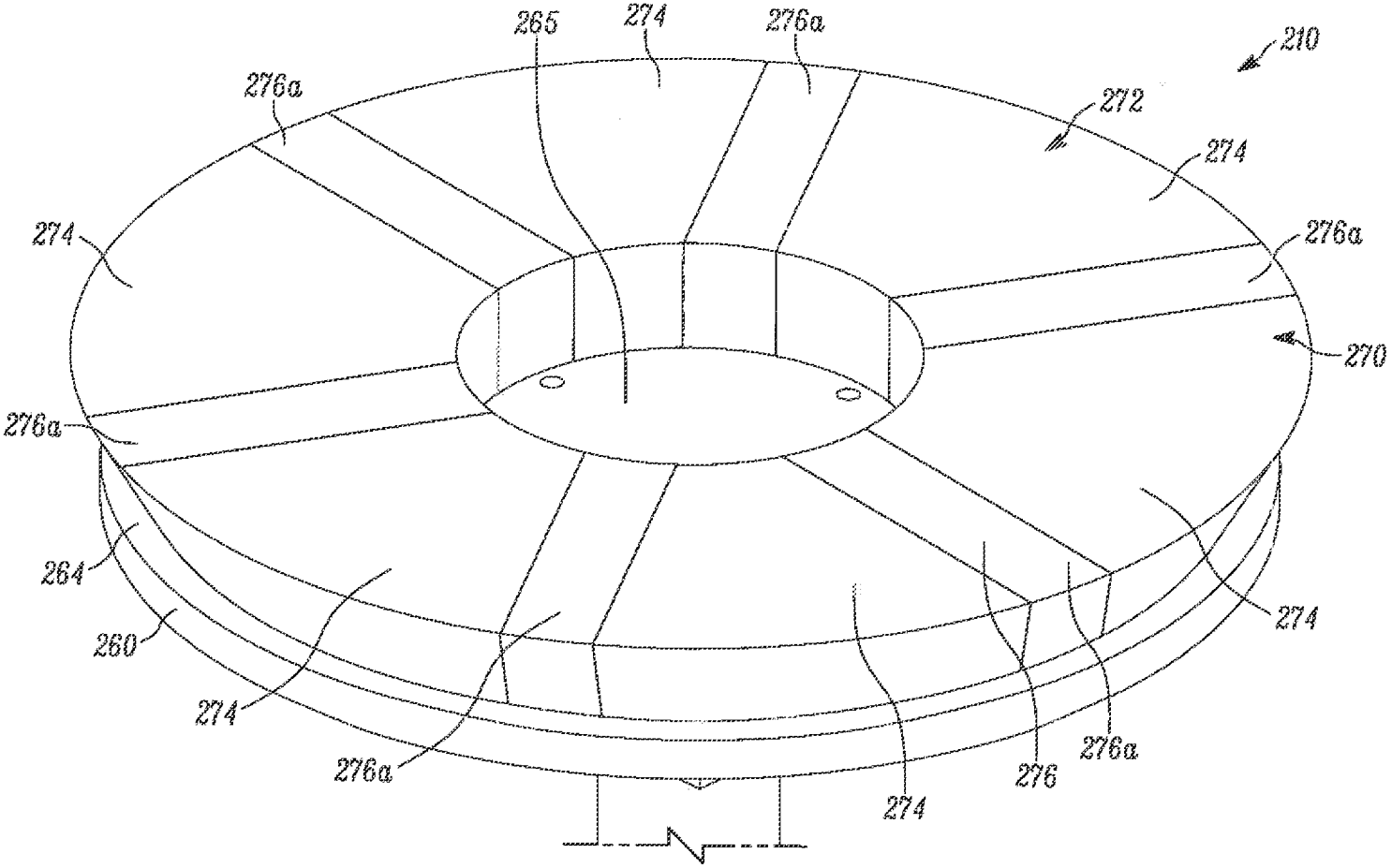
FIG. 15 is a schematic bottom perspective view of the brush of FIG. 14.

As can best be seen schematically in FIGS. 14 and 15, in one exemplary embodiment, plurality of bristles 270, in the shape of an annulus 272 of bristles, extend downwardly from a lower surface 264 of the base 260. As can best be seen in FIG. 15, a central portion 265 of the lower surface 264 of the base 260, about nine inches in diameter, is open with no bristles 270. The bristle annulus 272 includes an alternating pattern of anion mix bristles 274 in the shape of pie sections, separated by rectangular blocks of polypropylene bristles 276. The alternating pattern of bristle annulus 272 is advantageous in that the polypropylene bristles 276 provide for stiffness and resulting strong agitation of the synthetic turf fibers, while union mix bristles 274, which are as blend of Palmyra and white Tampico fiber, being more flexible and less abrasive than the polypropylene bristles, provide for less we of the synthetic turf fibers during the brushing operation. In one exemplary embodiment, the bristles 270 extend downwardly approximately 1¾ inches from the bottom surface 264 of the base 260. The alternating pattern of bristles of the bristle annulus 272 include includes six rectangular blocks 276*a* of polypropylene bristles 276 evenly spaced about the circumference. Each block 276*a* of polypropylene bristles 276 extends approximately 1¾ inches along the outer circumference of the bristle annulus 272 and comprises an array of holes in the base 260. In one exemplary embodiment, the hole array for the six rectangular blocks 276*a* of polypropylene bristles 276 is four holes wide by nine holes deep array of bristles wherein each hole has a diameter of 0.281 mm. and includes approximately 70-100 bristles, each bristle having a diameter of approximately 0.025 inch. Thus, there are 216 holes in the base 260 for the polypropylene fibers. The area of the rectangular blocks, the alternating pattern of polypropylene and union mix bristles, and the, density of polypropylene bristles 276 in the bristle annulus 272 have been advantageously found to provide excellent agitation and removal of the field paint from the synthetic turf fibers. The diameter of the bristles of the union mix bristles 274 is in a range of 0.020-0.025 inch and there are a total of 510 holes of union mix bristles in the base 260.

As noted above, a diameter of each of the brushes 210, 220, 230 is approximately 20 inches, when the brush assembly 200 is in the retracted position 201. The two outer brushes 210, 220 are mounted on the brush frame 240 approximately 19 inches outwardly from the centerline or longitudinal axis LGA of the machine 100. Thus, when looking at the three brushes 210, 220, 230 from the front of the machine 100, when the brush assembly 200 is in the retracted position, the brushes overlap to form a horizontally extending brush path BPR that is slightly less than 60 inches. Nominally, the retracted position brush path BPR is approximately 59 inches in horizontal width.

Figure 16:
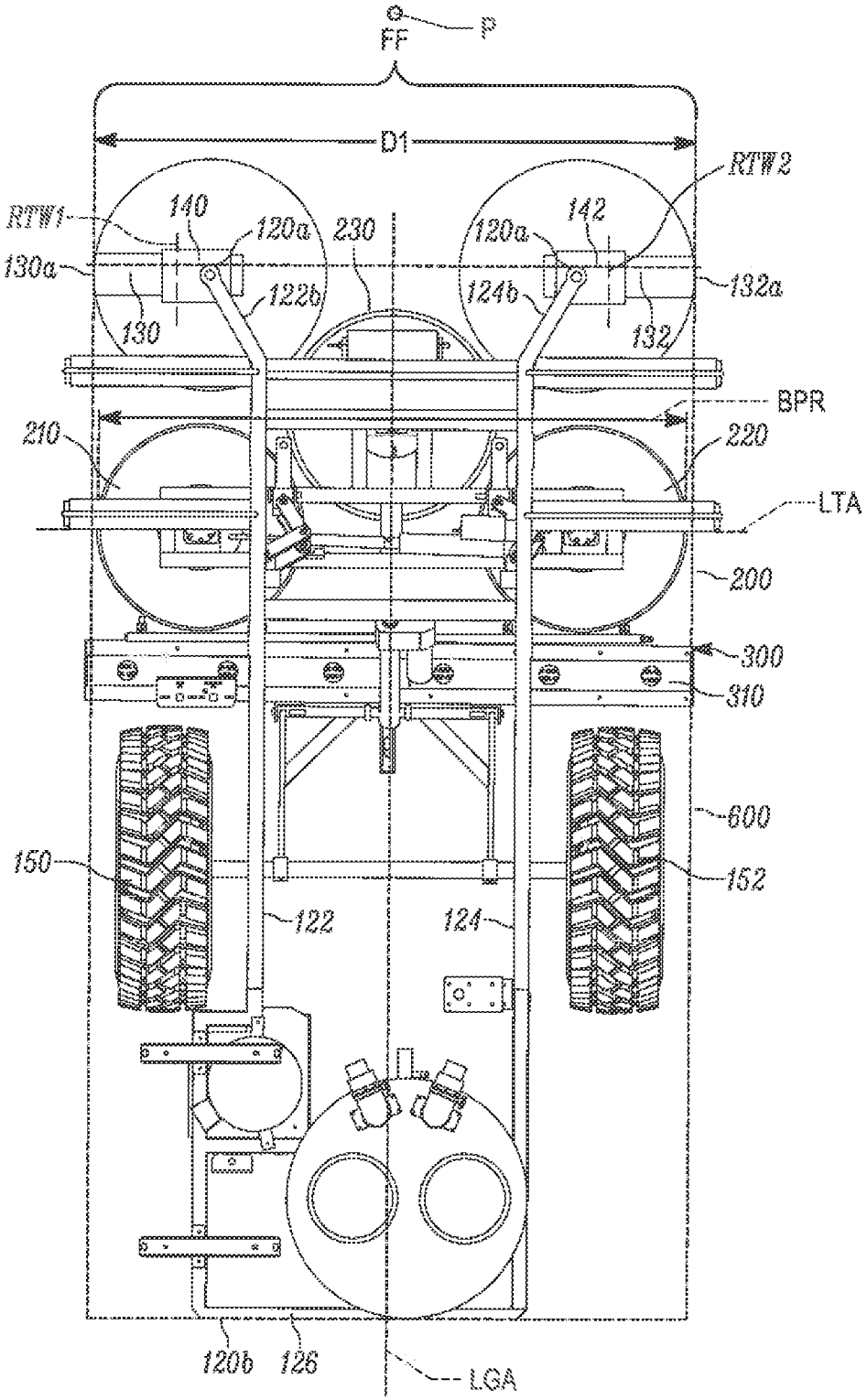
FIG. 16 is a schematic top plan view of the field paint removal and extraction machine of FIG. 1 showing first and second front turning wheels in a splayed position and a region corresponding to a front footprint of the rolling chassis.

Advantageously, as is schematically illustrated in FIGS. 16 and 6, the retracted position brush path BPR is within a front footprint Fl of the rolling chassis 110. The from footprint FF of the rolling chassis 110 is defined by a region (labeled as 600 in FIG. 16) that, looking from the top plan view of FIG. 16 extends from the front end 120*a* to the rear end 120*b* of the frame and extends in the rearward direction R, parallel to the longitudinal axis or centerline LGA, between the outermost edges 130*a*, 132*a* of the first and second front turning wheels 130, 132 when the first and second turning wheels 130, 132 are in a splayed position (as shown in FIG. 16) such that the axes of rotation RTW1 RTW2 of the first and second turning wheels 130, 132 are maximally spaced apart and are parallel to the longitudinal axis LGA of the machine 100. Stated another way, when the first and second turning wheels 130, 132 are turned outwardly to provide the largest possible distance D1 between the respective outermost edges 130*a*, 132*a* of the wheels 130, 132, the distance D1 defines the front footprint FF of the rolling chassis 110. When looking toward the front 102 of the machine 100 from a position (such as the position P in FIG. 16) that is forward of the machine 100, the retracted position brush path BPR is entirely within the distance D1, that is the retracted position brush path BPR is entirely within the front footprint FF of the rolling chassis 110, that is, entirely within the rectangular region 600, as shown in FIG. 16. When viewed from above, maximum radial extents of the outermost edges 130*a*, 132*a* of the first and second turning wheels 130, 132 from their respective axes of rotation RTW1, RTW2 arc schematically depicted by the circles labeled 135, 137 in FIG. 6. The distance D1 between the respective outermost edges 130*a*, 132*a* of the wheels 130, 132 is substantially equal to the distance between outermost portions of the circles 135, 137, that is, portions of the circles 135, 137 that are maximally spaced from the longitudinal axis LGA of the machine 100.

In one exemplary embodiment, the distance D1 (FIGS. 6 and 16) and thus the front footprint FF is approximately 60 inches. As noted above, in the retracted position, the brush path BPR is 59 inches. Both the front footprint FT and the retracted brush path BPR are symmetric with respect to the longitudinal axis LGA of the machine 100. This configuration of the rolling chassis 110 wherein the retracted position brush path BPR, is within the front footprint FF of the roiling chassis 110 leads to a compact design and improved maneuverability compared to competitive paint remover and extraction machines. Additionally, the compact design permits the use of four wheels which reduces tracking (that is, compression of the synthetic turf due to being run over by a wheel) compared to competitive machines that utilize six or eight wheels. Additionally, storage space requirements are reduced given the compact design of the machine 100.

When the brush assembly 200 is in the downward position, the brush bristles 270 are pressed against the ground (synthetic turf) and thus the plurality of bristles 240 tend to spread outwardly from the base 260. The amount of the spread of the plurality of bristles 270 is determined by a number of factors including stiffness and length of the bristles and the downward force applied to the ground by the bristles 270. The downward force applied to the ground by the plurality of bristles 270 is a function of the downward pressure applied by the actuator 245 to the brush frame 240. In one exemplary embodiment, in moving from the retracted position of the brush assembly 200 to the downward position of the brush assembly 200, the brush path increases from 59 inches to 61 inches, a distance just slightly greater than the front footprint FF of the rolling chassis 110.

Vacuum Assembly 400

As is best seen in FIGS. 4-5, 7-13, the vacuum assembly 400 includes vacuum bar 310, the manifold 372, the pair of vacuum hoses 375, and the vacuum extraction holding tank 370. Additionally, two vacuums 395 are positioned atop the extraction holding tank 370 to draw the suction in the vacuum assembly 400 including the vacuum bar 310. The vacuum hoses 375 are in fluid communication with the plenum 340 of the vacuum bar 310 and, via suction pressure, route the dislodged and/or dissolved paint extracted from the artificial turf by the vacuum pad 320 of the vacuum bar 310 to the holding tank 370. The holding tank 370 includes a drain to permit the contents of the holding tank 370 to be drained and disposed of. In addition to the removed paint, the vacuum assembly 400 also suctions up any paint dissolving solution applied by the spray boom assembly 400 and any rinse water applied by the pre-vacuum water spray assembly 500. The vacuum extraction holding tank 370 may be a 55 gallon drum.

The vacuum bar 310 is supported for pivoting movement vacuum bar frame 380 The vacuum bar frame 380 is pivotally coupled to the parallel central portions 122*a*, 122*b* of the frame rails 122, 124 and is actuated by a linear actuator 390 which moves the vacuum bar frame 380 and thus the vacuum bar 310 between an upward or retracted position wherein the vacuum bar 310 is spaced above the ground and a downward or ground-contacting position where the vacuum bar 310 is in contact with and presses forcefully against the ground. The downward position of the vacuum assembly 300, including the vacuum bar 310 is shown at 301, for example, in FIGS. 5 and 6 wherein the vacuum bar 310 is in contact with the ground G and is horizontally level with lowermost surface of the rear drive wheels 150, 152. The actuator 390 may be a 6 inch stroke, ball screw drive. In one exemplary embodiment, in the downward position 301 of the vacuum assembly 300, the vacuum pad 320 is under subjected to approximately 300 pounds of spring pressure and angled forward approximately five degrees to keep the pad 320 firmly against the ground. The vacuum bar 310 is mounted by the frame 380 such that it is perpendicular to the longitudinal axis LGA of the machine 100 and parallel to the lateral axis LTA.

Figure 11:
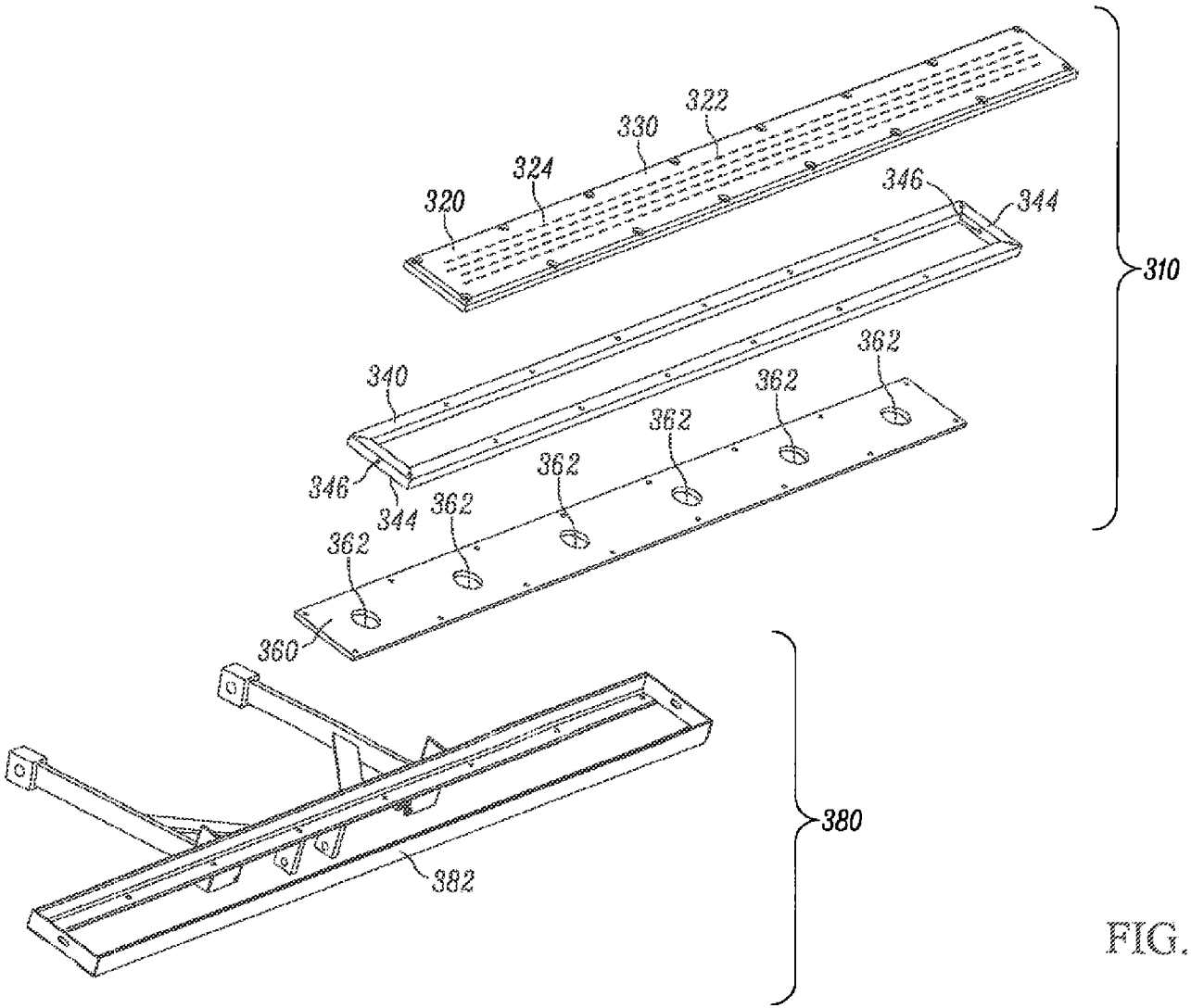
FIG. 11 is a schematic exploded bottom perspective plan view a vacuum bar of the vacuum assembly of FIG. 1.
Figure 12:
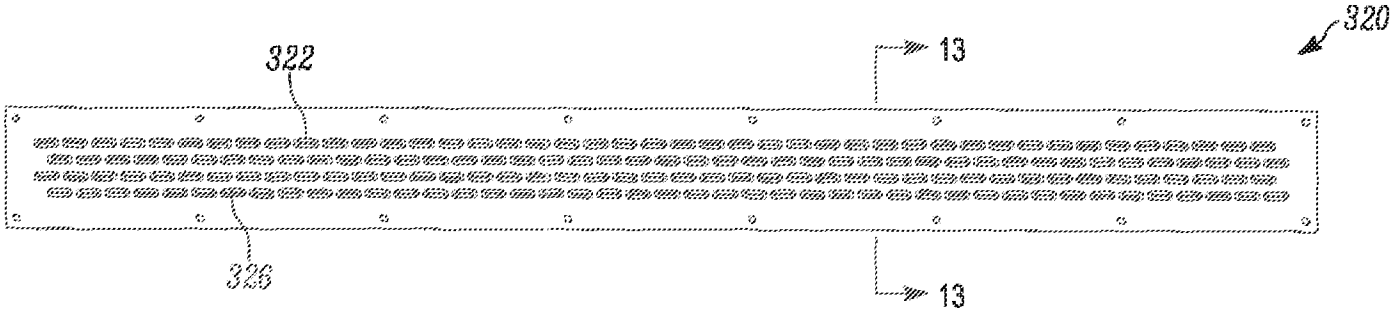
FIG. 12 is a schematic top plan vie of the vacuum pad of the vacuum bar of FIG. 11.
Figure 13:
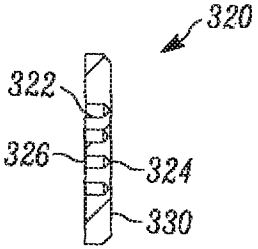
FIG. 13 is a schematic section view of the vacuum, pad of FIG. 12, as seen from a plane indicated by the line 13-13 in FIG. 12.

As can best be seen in the exploded perspective view of FIG. 11, the vacuum bar 310 includes the around contacting vacuum pad 320, the plenum or suction chamber 340 overlying the vacuum pad, and a top plate 360 overlying the plenum 340. In one exemplary embodiment, the vacuum pad 320 includes a plurality of vacuum ports 322 arranged in four rows and is approximately 60 inches wide such that the effective suction path of the vacuum bar 310 substantially matches the brush path of the bush assembly 200 in the downward position. The width of the vacuum pad 320, in one exemplary embodiment, is approximately 5.5 inches when measured along the longitudinal axis LGA. In one exemplary embodiment, the number of ports 322 is four rows of 43 ports, each row having the ports arranged in offset or overlapping fashion when viewed along the longitudinal axis LGA.

The vacuum pad 320 may be fabricated from any suitable material such as, for example, ultra-high-molecular-weight polyethylene. On a bottom surface 330 of the vacuum pad 320, the ports 322 terminate in slot-shaped openings or vacuum orifices 324. In one exemplary embodiment, the size of each orifice 324 is 1/16 inch wide by 3/4 inch in length. Like the plurality of brushes 210, 220, 230 of the brush assembly 200, the plurality of vacuum ports 322, including the slot-shaped openings or vacuum orifices 324 of the ports 322 of the vacuum pad 320 of the vacuum bar 310, are within the front footprint FF of the rolling chassis 110, as can be seen schematically in FIG. 16.

The slotted orifice configuration and the specific orifice size for the orifices 324, as described above, has been fund to strike a proper balance between: a) an opening size of the orifices 324 are large enough to provide for suctioning of a sufficient volume of extracted paint and wash water from the pre-vacuum water spray assembly 500 such that the vacuum assembly 300 functions as desired in the extraction process; b) the opening size of the orifices 324 is large enough such that the orifices 324 are not prone to clogging; and c) the opening size of the orifices 324 is still small enough to minimize the amount of infill material (sand and/or rubber) extracted from the artificial turf during the extraction process.

One of the goals of the extraction process is to maximize the volume of wash water that can be applied to the artificial turf and then successfully vacuumed up so as not to leave an undue amount of wash water on the artificial turf after the vacuum process, while at the same time minimizing that amount of infill material that is extracted from the artificial turf. This requires a balance between a vacuum suction force that is too small (which will leave too much wash water and dislodged/dissolved paint on the turf) and a vacuum suction force that is too large (which will extract all of the wash water and dislodged/dissolved paint but will harm the turf by removing too much infill material). The slotted orifice configuration and size described above has been found to be very suitable in properly balancing vacuum suction force. Various other orifice configurations (e.g., round holes) were tested but not found to work as well as the slotted configuration and size, as described above. As can best be seen in FIG. 13, in one exemplary embodiment, the ports 322 of the vacuum pad 320 widen from the inlet orifices 324 at a 45 degree angle outwardly to an exit end 326 of the ports 322, have a width of ⅜ inch by ¾ inch in length at the exit end 326.

The plenum 340 overlies the vacuum pad 320 and routes the extracted dislodged and dissolved paint to the vacuum hoses 375. In one exemplary embodiment, the plenum is approximately ¾ inch thick and essentially defines a frame or perimeter that is approximately one inch wide. The plenum 340, in turn, is overlied by a ⅜ inch thick top plate 360 which seals the vacuum bar 310. In one exemplary embodiment, the top plate 360 is ⅜ inch thick for a total thickness of the vacuum bar 310 of 1⅞ inch (¾ inch for the vacuum pad 320 plus ¾ inch for the plenum 340 plus ⅜ inch for the top plate 360).

Figure 8:
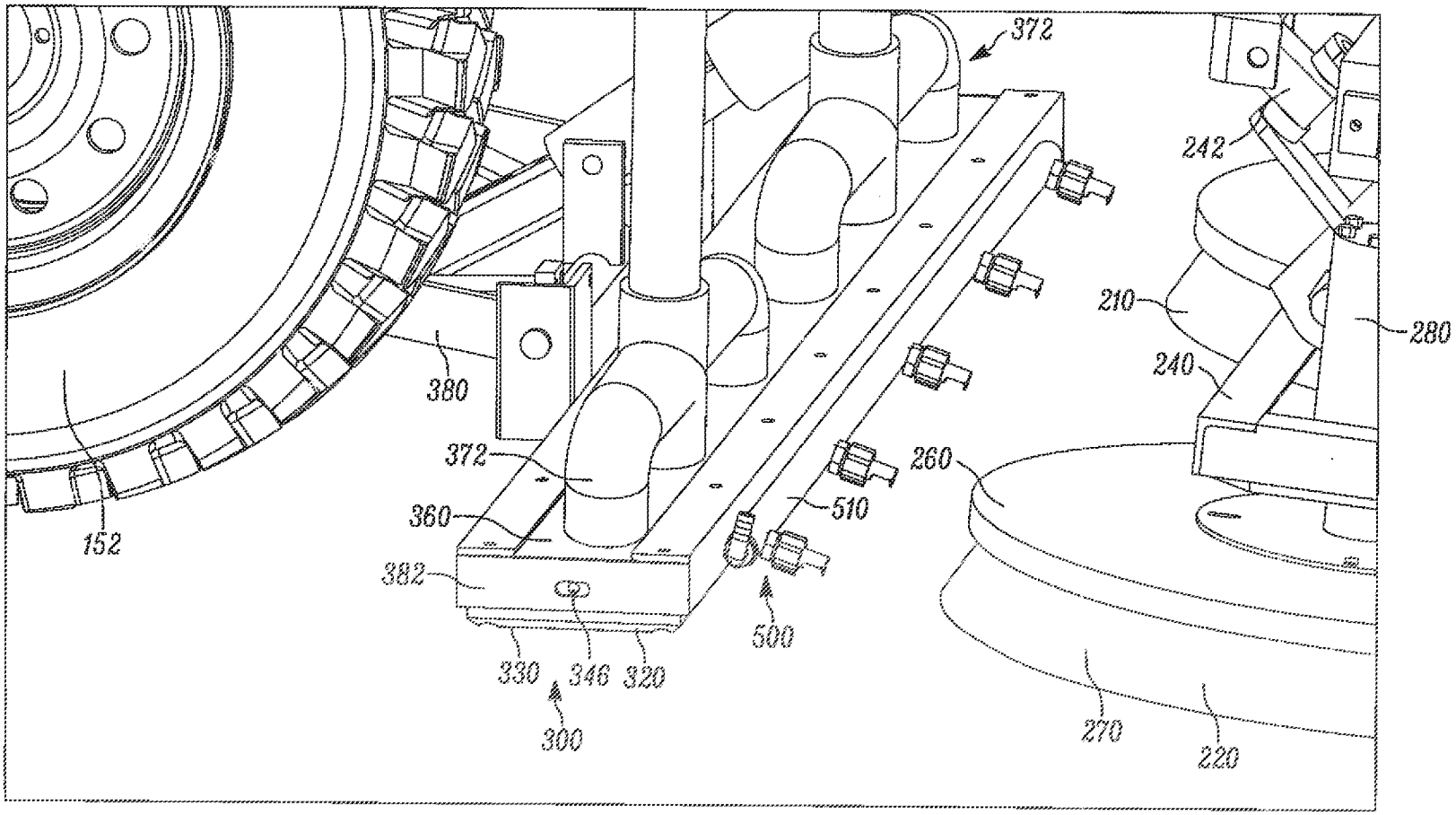
FIG. 8 is a schematic enlarged front perspective view of a portion of the brush assembly and the vacuum assembly of the machine.
Figure 9:
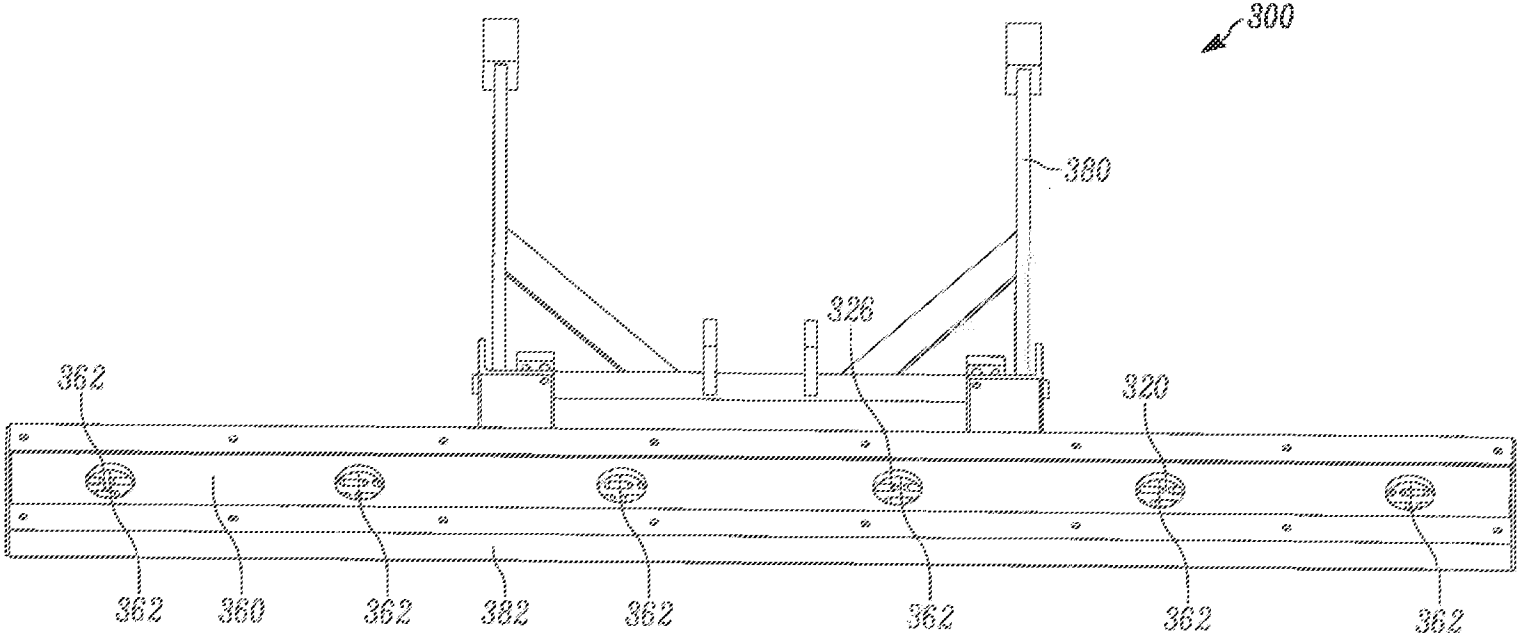
FIG. 9 is a schematic top plan view of the vacuum assembly of the field paint remover and extraction machine of FIG. 1.
Figure 10:
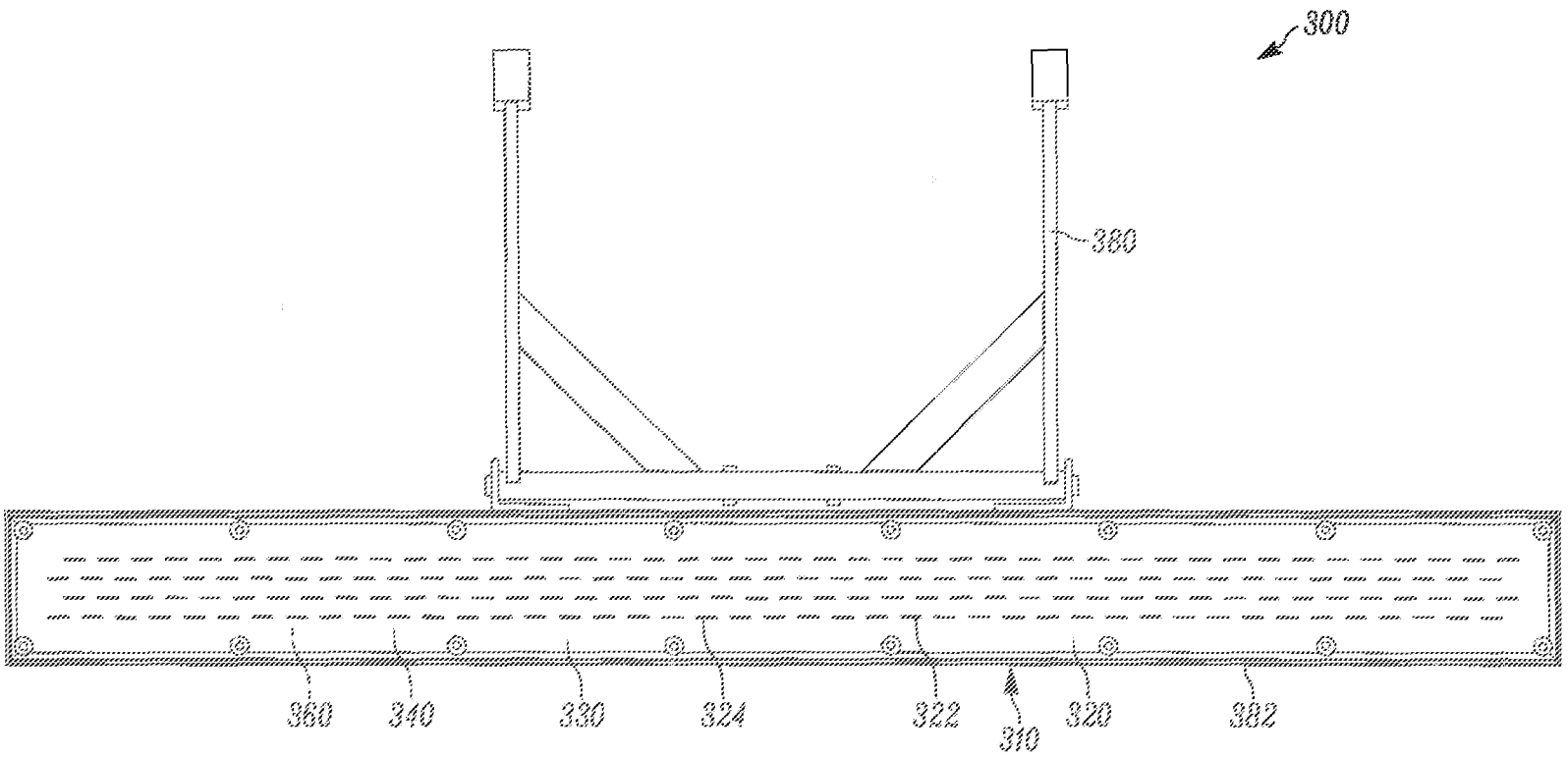
FIG. 10 is a schematic bottom plan view of the vacuum assembly of the field paint remover and extraction machine of FIG. 1.

The top plate 360 includes a series of six circular openings 362, which receive six respective fittings of the manifold 372 (FIG. 8). The manifold 372 provides a path of fluid communication between the vacuum bar 310 and the vacuum hoses 375 to route extracted paint and water from the ports 322 of the vacuum pad 320 to the vacuum extraction holding tank 370 under vacuum pressure provided by the pair of vacuums 395. Along shorter ends 344 of the plenum 340, ¼ inch openings 346 pass through the plenum 340 to facilitate tow of extracted paint and water from the vacuum pad 320, through the plenum 340 and out through the top plate 360. All joints between the vacuum pad 320, the plenum 340 and the top plates 360 are siliconed together. The plenum 340 and the top plate 360 may be fabricated of any suitable material, for example, polycarbonate. The vacuum bar 310 fits into and is affixed to rectangular-shaped distal portion 382 of the vacuum assembly frame 380.

Spray Boom Assembly 400

In one exemplary embodiment, the spray boom assembly 400 includes a spray boom 410 and the holding tank 420, which stores the paint dissolving solution used in the first or conditioning 110 run. The spray boom 410, best seen in FIGS. 4 and 5, includes a spray bar 412 mounted to the frame 120 in a direction perpendicular to the longitudinal axis LGA of the machine 100. The spray bar 412 includes a plurality of spray nozzles for dispensing the paint dissolving solution. The spray bar 412 is mounted to the frame 120 near the transition between the central portions 122*a*, 124*a* and rear portions 122*c*, 124*c* of the frame rails 122, 124. The spray boom assembly 400 also includes a separate liquid pump to dispense the paint dissolving, solution through the spray bar 412, The spray bar 412 is within the front footprint FF of the rolling chassis 110.

Pre-Vacuum Water Spray Assembly 500

In one exemplary embodiment, the pre-vacuum water spray assembly 500 includes a spray bar 510 and a pair of water holding tanks 520 which stores wash water for wetting the field prior to vacuuming with the vacuuming assembly to rinse any paint dissolving solution from the synthetic turf fibers. The spray bar 510, best seen in FIG. 8, is mounted to the frame 120 in a direction perpendicular to the longitudinal axis LGA of the machine 100. The spray bar 510 includes a plurality of spray nozzles for dispensing the wash water. The spray bar 510 is mounted to the central portions 122*a*, 124*a* of the frame rails 122, 124 just forward of the vacuum bar 410. The pre-vacuum water spray assembly 400 also includes a separate liquid pump to dispense the wash water through the spray bar 510. The spray bar 510 is within the front footprint FF of the rolling chassis 110.

The water holding tanks 520 are mounted to the frame 120 as outriggers on the central portions 122*a*, 124*a* of the frame rails 122, 124. The water holding tanks 520, which are not part of the rolling chassis 510, are wider than the front footprint FF of the roiling chassis 110, as described previously. The water holding tanks 520 define the overall width of the machine 100. In one exemplary embodiment, the, overall width of the machine is 66 inches.

Extra weight may be added to the forward portions 122*b*, 124*b* of the frame 120 to act a counterbalance to keep the front turning wheels 130, 132 on the ground in situations where the machine 100 is operated with water tanks are empty or nearly empty and the extraction holding tank 370 is full or nearly full.

Auxiliary Wheel Spray Assemblies 700, 710

Advantageously, auxiliary wheel spray assemblies 700, 710 are provided to spray wash water on the rearward facing surfaces of the front turning wheels 130, 132 and the rearward facing surfaces of the rear drive wheels 150, 152 of the machine to minimize paint tracking by the wheels on the cleaned sections of the athletic field. In FIG. 4, a first auxiliary wheel spray assembly 700 is shown for spraying water the rear drive wheel 150. The spray assembly 708 includes a short spray bar 702 supporting a pair of spray nozzles that direct a water spray on the wheel 152 to clean any paint or infill adhering to the wheel. As shown in FIG. 5, a matching spray assembly 700 is provided for the other rear drive tire 152. Water for the first auxiliary wheel spray assembly 700 is drawn from the twin holding tanks 520 of the pre-vacuum water spray assembly 500.

The second auxiliary wheel spray assembly 710 is positioned rearward of the front turning wheels 130, 132. The second auxiliary wheel spray assembly 710 directs a water spray on a rearward facing surfaces of the front turning wheels 130, 132, as shown in FIGS. 4 and 5. When the machine 100 is moving in the forward F direction, the spray assembly 710 sprays the rearward facing surfaces of the front turning wheels 130, 132 with wash water. However, when the machine is reversed, that is, moving in the rearward direction R, the spray, the wheels 130, 132 pivot about on the caster assemblies 140, 142 and the water spray does not reach the wheels 130, 132 since the wheels are more distant from the spray nozzles of the spray bars of the second auxiliary wheel spray assembly 710.

What have been described above are examples of the present invention/disclosure. It is, of course, not possible to describe every conceivable combination of components or methodologies for purposes of describing the present invention/disclosure, but one of ordinary skill in the art will recognize that many further combinations and permutations of the present invention/disclosure are possible. Accordingly, the present invention is intended to embrace all such alterations, modifications, and variations that fall within the spirit and scope of the appended claims.

What is claimed is:

1. A paint removal and extraction machine comprising:

a self-propelled rolling chassis including a frame having a front end and a back end and pair of spaced apart longitudinally extending rails defining a longitudinal axis of the machine centered between and parallel to the pair of rails and a lateral axis orthogonal to the longitudinal axis and extending through the longitudinally extending rails, first and second front turning wheels coupled to the front end of the frame by respective first and second caster assemblies, the first and second front turning wheels defining first and second turning wheel axes of rotation, respectively, and the first and second caster assemblies defining first and second caster axes of rotation, respectively, the first and second caster axes of rotation being orthogonal to the first and second turning wheel axes of rotation, first and second drive wheels coupled to the frame, rotation of at least one of the first and second drive wheels propelling the rolling chassis, the rolling chassis having no more than four wheels including the first and second front turning wheels and the first and second drive wheels;

a brush assembly supported by the frame rearward of the first and second caster assemblies and including a brush frame movable between a first position and a second position, a first outer brush mounted to the brush frame and rotating about a first brush axis of rotation and a second outer brush mounted to the brush frame and rotating about a second brush axis of rotation, in the first position of the brush frame, the first outer brush and the second outer brush in an upward position and in the second position of the brush frame, the first outer brush and the second outer brush in a downward ground-contacting position, the first brush axis of rotation of the first outer brush and the second brush axis of rotation of the second outer brush being laterally spaced from and outside of the pair of rails of the frame; and a vacuum assembly supported by the frame rearward of the brush assembly and including a vacuum bar frame movable between a first position and a second position and a vacuum bar supported by the vacuum bar frame and located forward of the first and second drive wheels, the vacuum bar including a vacuum pad having a plurality of vacuum ports, in the first position of the vacuum bar frame, the vacuum pad being in an upward position and in the second position of the vacuum bar frame, the vacuum pad in a downward ground-contacting position; and wherein the first outer brush and the second outer brush, in the retracted position of the brash assembly, are within a front footprint of the rolling chassis, that is, a region of the rolling chassis extending rearwardly parallel to the longitudinal axis between the outermost edges of the first and second front turning wheels when the first and second turning wheels are in a splayed position such that the axes of rotation of the first and second turning wheels are maximally spaced apart and parallel to the longitudinal axis.

2. The paint removal and extraction machine of claim 1 wherein the plurality of vacuum ports of the vacuum pad are within the front footprint of the rolling chassis.

3. The paint removal and extraction machine of claim 1 wherein the brush assembly further includes a middle brush mounted to the brush frame and rotating about a middle brush axis of rotation, the first outer brush, the second outer brush and the middle brush defining overlapping brush paths as viewed from the front end of the frame.

4. The paint removal and extraction machine of claim 1 wherein the first and second brush axes of rotation are orthogonal to the longitudinal axis and the lateral axis of the machine.

5. The paint removal and extraction machine of claim 1 wherein the first and second caster axes of rotation are orthogonal to the longitudinal and lateral axes of the machine.

6. The paint removal and extraction machine of claim 1 wherein first and second spray assemblies are coupled to the frame in proximity to the first and second front turning wheels, respectively, and direct a water spray on the first and second front turning wheels.

7. The paint removal and extraction machine of claim 6 wherein the first and second spray assemblies each include a spray bar and at least one spray nozzle mounted to the spray bar, water being routed through the respective spray bars and the at least one spray nozzles to direct a water spray on the first and second front turning wheels.

8. The paint removal and extraction machine of claim 6 wherein the first and second spray assemblies each include a spray bar and at least one spray nozzle mounted to the spray bar, water being routed through the respective spray bars and the at least one spray nozzles to direct a water spray on the first and second drive wheels.

9. The paint removal and extraction machine of claim 1 wherein third and fourth spray assemblies are coupled to the frame in proximity to the first and second drive wheels, respectively, and direct a water spray on the first and second drive wheels.

10. The paint removal and extraction machine of claim 1 wherein a spray boom is coupled to the frame, the spray boom including a spray bar extending perpendicular to the longitudinal axis of the machine and a plurality of spray nozzles mounted to the spray bar, paint dissolving solution being routed through the spray bar and the plurality of spray nozzles to direct paint dissolving solution downwardly.

11. The paint removal and extraction machine of claim 1 wherein a pre-vacuum water spray supported by the frame is located forward of the vacuum bar.

12. A paint removal and extraction machine comprising:

a self propelled rolling chassis including a frame having a front end and a back end and pair of spaced apart longitudinally extending rails defining a longitudinal axis of the machine centered between and parallel to the pair of rails and a lateral axis orthogonal to the longitudinal axis and extending through the longitudinally extending rails, first and second front turning wheels coupled to the front end of the frame by respective first and second caster assemblies, the first and second front turning wheels defining first and second turning wheel axes of rotation, respectively, and the first and second caster assemblies defining first and second caster axes of rotation, respectively, the first and second caster axes of rotation being orthogonal to the first and second turning wheel axes of rotation, first and second drive wheels coupled to the frame, rotation of at least one of the first and second drive wheels propelling the rolling chassis, the rolling chassis having no more than four wheels including the first and second front turning wheels and the first and second drive wheels;

a brush assembly supported by the frame rearward of the first and second caster assemblies and including a brush frame movable between a first position and a second position, a first outer brush mounted to the brush frame and rotating about a first brush axis of rotation and a second outer brush mounted to the brush frame and rotating about a second brush axis of rotation, in the first position of the brush frame, the first outer brush and the second outer brush in an upward position and in the second position of the brush frame, the first outer brush and the second outer brush in a downward ground-contacting position, the first brush axis of rotation of the first outer brush and the second brush axis of rotation of the second outer brush being laterally spaced from and outside of the pair of rails of the frame; and a vacuum assembly supported by the frame rearward of the brush assembly and including a vacuum bar frame movable between a first position and a second position and a vacuum bar supported by the vacuum bar frame, the vacuum bar including a vacuum pad having a plurality of vacuum ports, in the first position of the vacuum bar frame, the vacuum pad being in an upward position and in the second position of the vacuum bar frame, the vacuum pad in a downward ground-contacting position; and wherein the plurality of vacuum ports of the vacuum pad are within the front footprint of the rolling chassis.

13. The paint removal and extraction machine of claim 12 wherein the first outer brush and the second outer brush, in the retracted position of the brush assembly, are within a front footprint of the rolling chassis, that is, a region of the rolling chassis extending rearwardly parallel to the longitudinal axis between the outermost edges of the first and second front turning wheels when the first and second turning wheels are in a splayed position such that the axes of rotation of the first and second turning wheels are maximally spaced apart and parallel to the longitudinal axis.

14. The paint removal and extraction machine of claim 12 wherein the brush assembly further includes a middle brush mounted to the brush frame and rotating about a middle brush axis of rotation, the first outer brush, the second outer brush and the middle brush defining overlapping brush paths as viewed from the front end of the frame.

15. The paint removal and extraction machine of claim 12 wherein the first and second brush axes of rotation are orthogonal to the longitudinal axis and lateral axis of the machine.

16. The paint removal and extraction machine of claim 12 wherein the first and second caster axes of rotation are orthogonal to the longitudinal and lateral axes of the machine.

17. The paint removal and extraction machine of claim 12 wherein the vacuum bar is located forward of the first and second drive wheels.

18. The paint removal and extraction machine of claim 12 wherein first and second spray assemblies are coupled to the frame in proximity to the first and second front turning wheels, respectively, and direct a water spray on the first and second front turning wheels.

19. The paint removal and extraction machine of claim 12 wherein third and fourth spray assemblies are coupled to the frame in proximity to the first and second drive wheels, respectively, and direct a water spray on the first and second drive wheels.

20. The paint removal and extraction machine of claim 12 wherein a pre-vacuum water spray supported by the frame is located forward of the vacuum bar.

* * * * *